US006790008B1

(12) United States Patent
Huang

(10) Patent No.: US 6,790,008 B1
(45) Date of Patent: Sep. 14, 2004

(54) INTEGRATED STRUCTURE OF CEILING FAN BASE AND FRAME

(76) Inventor: Yu-Keng Huang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/435,541

(22) Filed: May 12, 2003

(51) Int. Cl.[7] ..... F04D 29/64
(52) U.S. Cl. ..... 416/244 R; 248/343
(58) Field of Search ..... 416/5, 210 R, 416/244 R, 246; 248/342, 343, 344

(56) References Cited

U.S. PATENT DOCUMENTS 4,729,725 A * 3/1988 Markwardt ..... 416/244 R
4,878,806 A * 11/1989 Markwardt ..... 416/5

* cited by examiner

*Primary Examiner*—Christopher Verdier

(57) ABSTRACT

An integrated structure of ceiling fan base and frame includes a base and a frame. The characteristics thereof are that, between the base thereof and the frame thereof is a inner rim that is disposed with a plurality of openings and a plurality of reinforcement ribs at equidistant locations of an inner periphery thereof, and each of the pin openings is placed with a pin; the shape of an inner periphery of the frame is corresponded with an outer periphery of the inner rim, and two clasp portions are disposed at the frame so as to fasten and connect the frame around the inner rim; and at positions having largest diameters on a periphery of the base is provided with a plurality of orifices corresponding to the pins at the inner rim so as to wedge the heads of the pins into the orifices of the base for assembly.

3 Claims, 5 Drawing Sheets

INTEGRATED STRUCTURE OF CEILING FAN BASE AND FRAME

BACKGROUND OF THE INVENTION (a) Field of the Invention

The invention relates to an integrated structure of a ceiling fan base and frame, and more particularly, to an integrated structure of a ceiling fan base and frame that provides easy disassembly of the frame and facilitates a burnishing process thereof, as well as enhancing esthetical values of the ceiling fan.

(b) Description of the Prior Art

Referring to FIG. 3 showing an integrated structure of a prior art ceiling fan base and frame, the structure thereof comprises a base a and a frame b. Wherein, the frame b is disposed with a plurality of reinforcement ribs b1 at appropriate and equidistant positions of an inner periphery thereof for maintaining a shape and degree of circularity of the frame b, and two clasp portions b2 at an upper opening of the inner periphery thereof for fastening and connecting the frame b to the base a. When a ceiling fan c is fixed under a ceiling d using the base a, the frame b then covers the above structure for giving the ceiling fan d a more appealing appearance as shown in FIG. 4.

According to the aforesaid prior structure, it is necessary to press the frame b along vertical sides of the clasp portions b2 when mounting the frame onto the base a, so as to increase distances between the two clasp portions b2 for facilitating fastening the frame b to the base a. A similar procedure is also required for disassembling the frame b from the base a for further dismantling the ceiling fan off the ceiling. However, it is observed that the aforesaid structure has the disadvantages that, when the ceiling fan is fastened under the ceiling, the base a is pressed against the ceiling, and thus attaching the frame b to the base a under the ceiling is indeed not easy; vice versa, dismantling the frame b off the base a is even more awkward for that which side of the frame b ought to be pressed cannot be decided plainly and forces required cannot be easily applied. Therefore, it is vital that the prior structure needs advancement.

Secondly, electroplating and burnishing of the prior frame b are only processed after being formed by plastic extrusion, and the inner periphery of the frame b is generally provided with a plurality of reinforcement ribs b1 at appropriate and equidistant positions for maintaining a complete shape and degree of circularity of the frame b. Nevertheless, the presence of the reinforcement ribs b1 at the inner periphery of the frame b creates significant differences in thickness of the ring-shaped frame, and shrinkage is frequently caused at locations of the reinforcement ribs b1. The shrinkage is accentuated after electroplating and burnishing, and thus affecting not only quality but also appeal as a whole, as well as further lowering economical values of the product.

SUMMARY OF THE INVENTION

In the view of the aforesaid prior integrated structure of a ceiling fan base and frame, the primary object of the invention is to provide an integrated structure of a ceiling, fan base and frame that provides easy disassembly of the frame and facilitates a burnishing process thereof, as well as enhancing esthetical values of the ceiling fan as a whole.

To accomplish the aforementioned object, according to the invention, between a base thereof and a frame thereof is an inner rim that is disposed with a plurality of openings and a plurality of reinforcement ribs at equidistant locations of an inner periphery thereof, and each of the pin openings is placed with a pin having a round arched head; the shape of an inner periphery of the frame is corresponded with an outer periphery of the inner rim, and two clasp. portions are disposed at corresponding positions at the inner periphery of the frame so as to fasten and connect the frame around the inner rim; and at positions having largest diameters on a periphery of the base are provided with a plurality of orifices corresponding to the pins at the inner rim so as to wedge the heads of the pins into the orifices of the base for assembly.

DETAILED DESCRIPTION OF THE PREFERRED EMBODIMENTS

To better understand the technical characteristics and functions of the invention, a preferred embodiment shall be described with the accompanying drawings hereunder.

Figure 1:
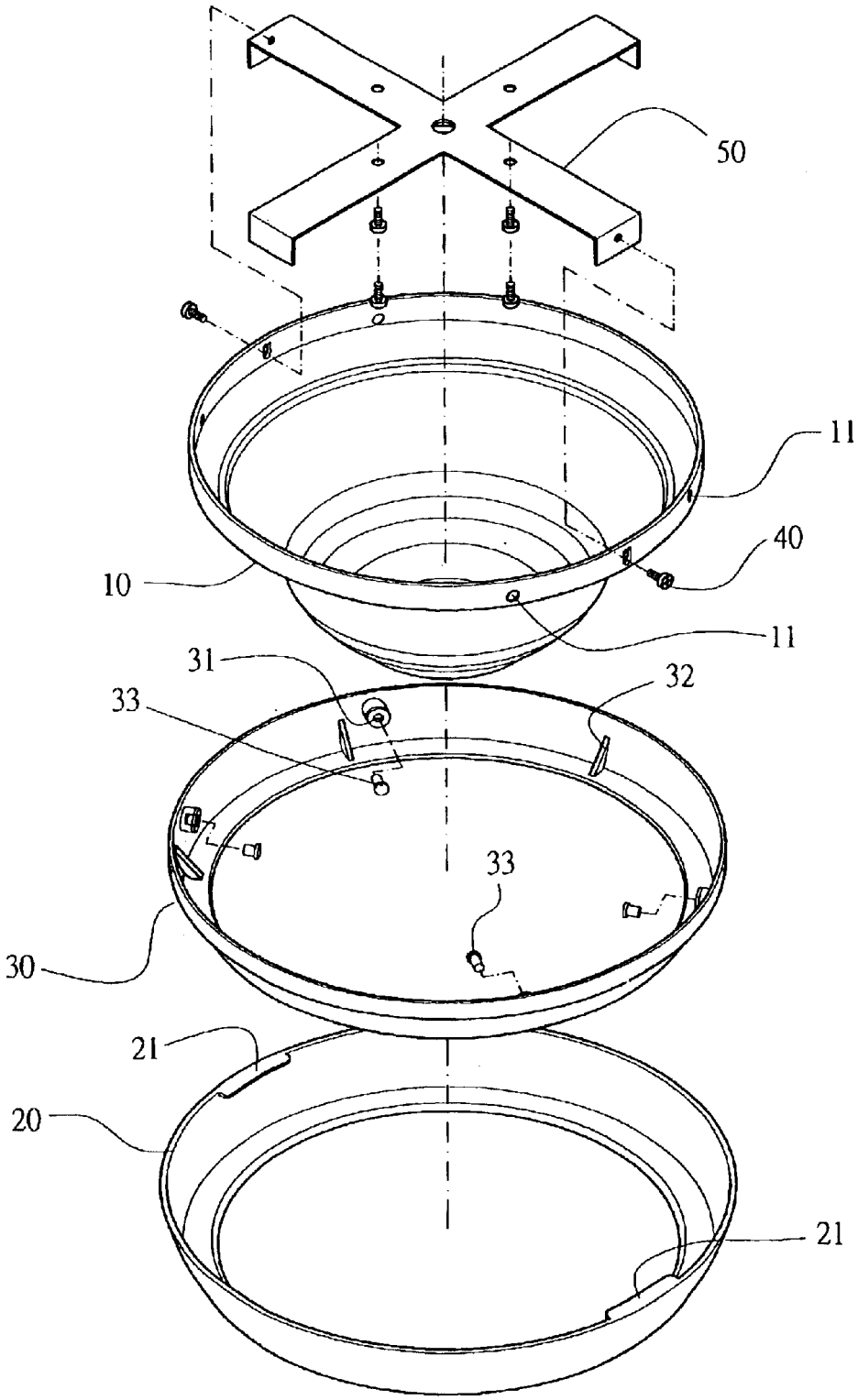
FIG. 1 shows an exploded elevational view of the integrated structure of a ceiling fan frame and base according to the invention.
Figure 2:
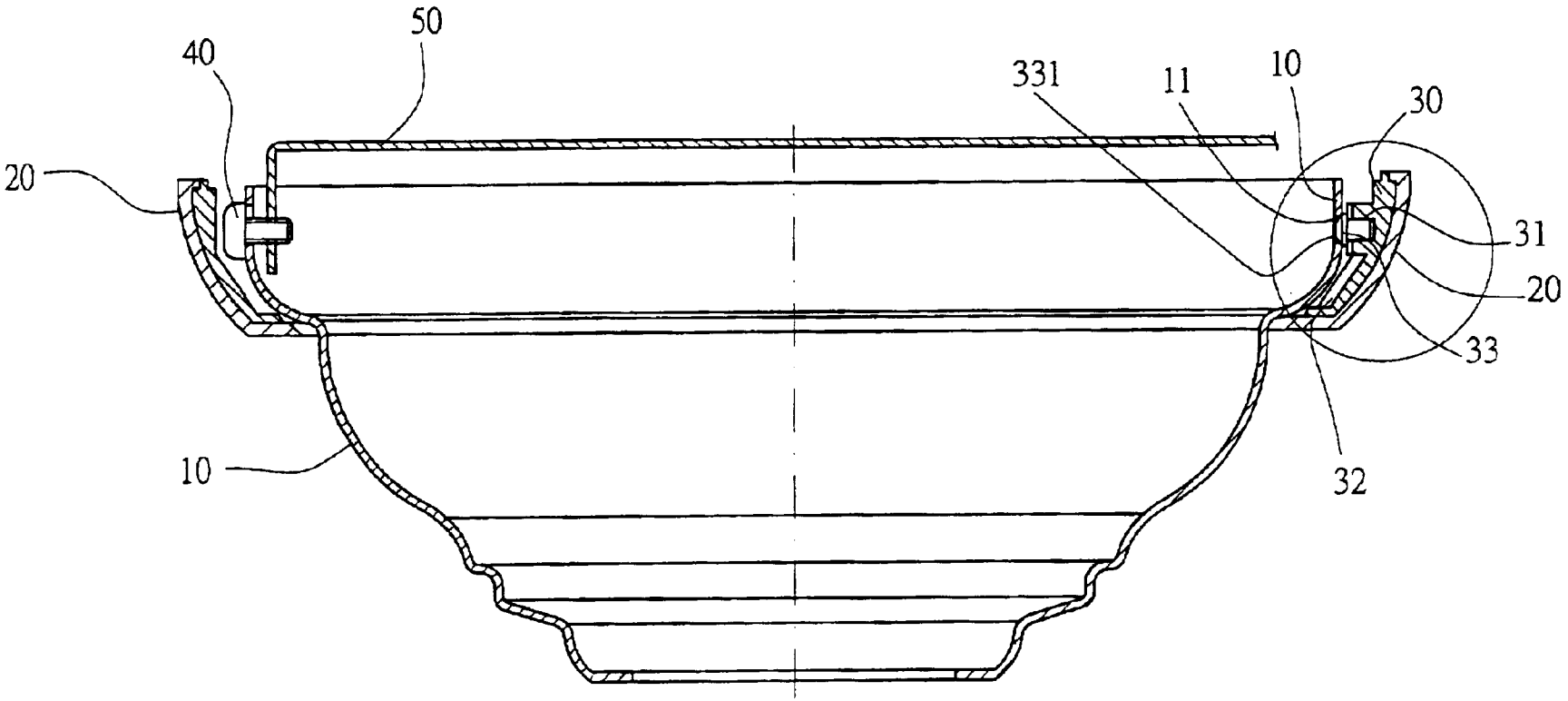
FIG. 2 shows a sectional side view according to the invention.
Figure 2A:
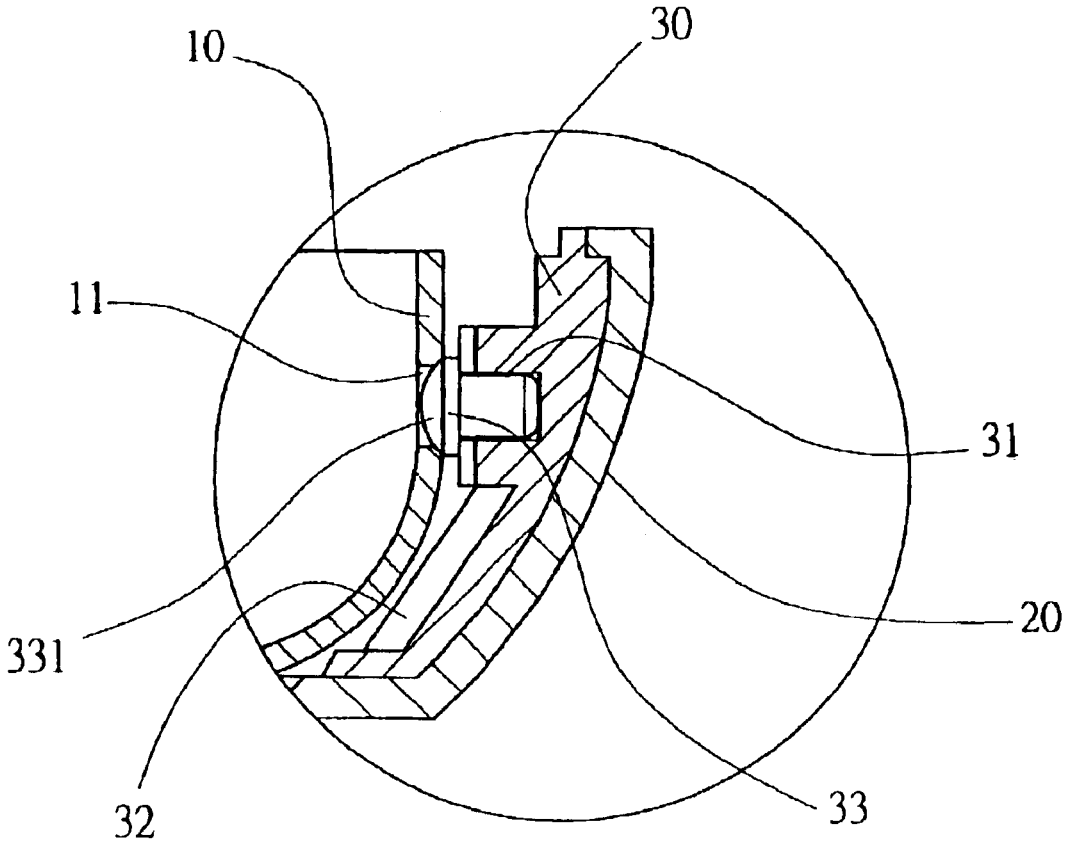
FIG. 2A shows a partial enlarged view of FIG. 2.
Figure 3:
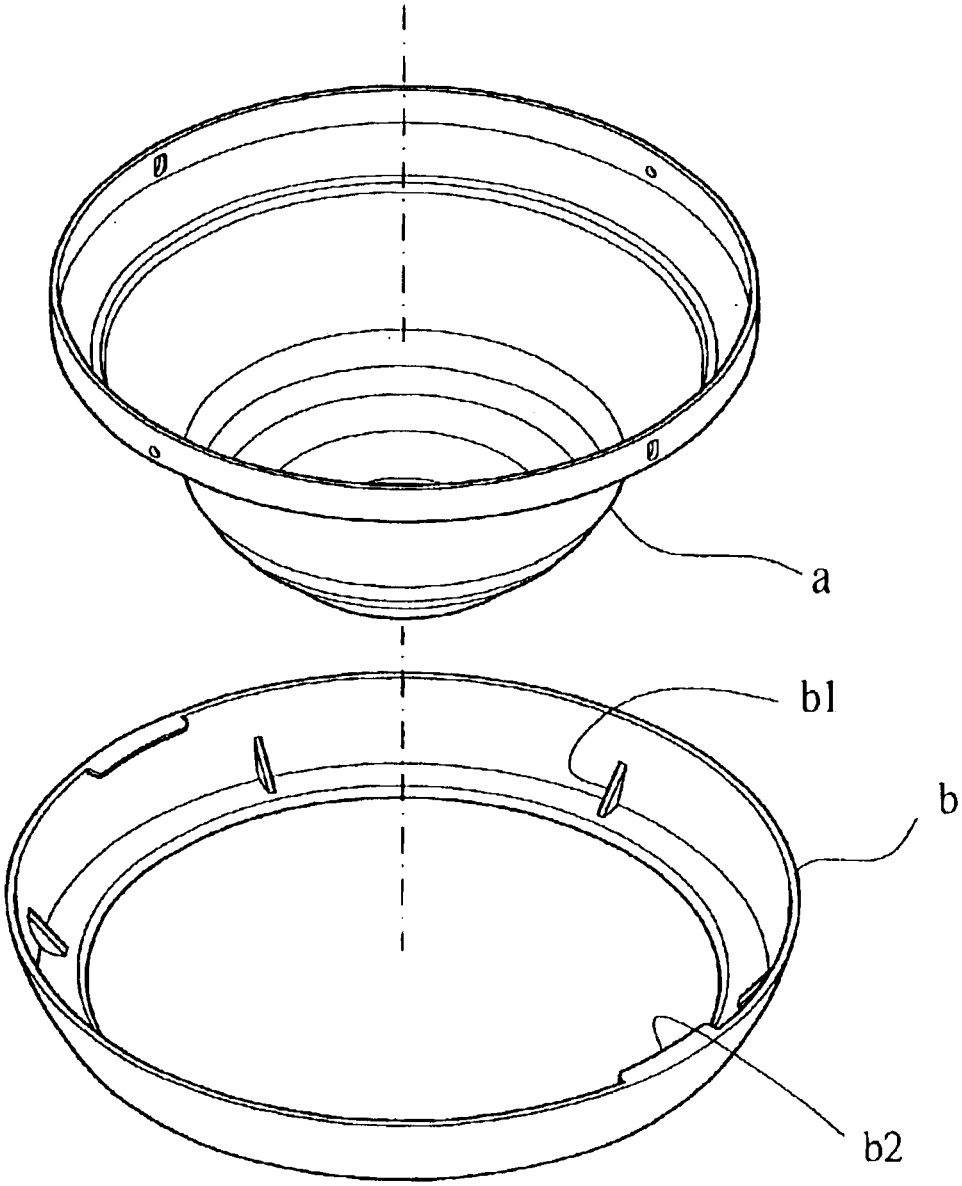
FIG.3 Prior Art
FIG. 3 shows a conventional exploded elevational view of the prior art.
Figure 4:
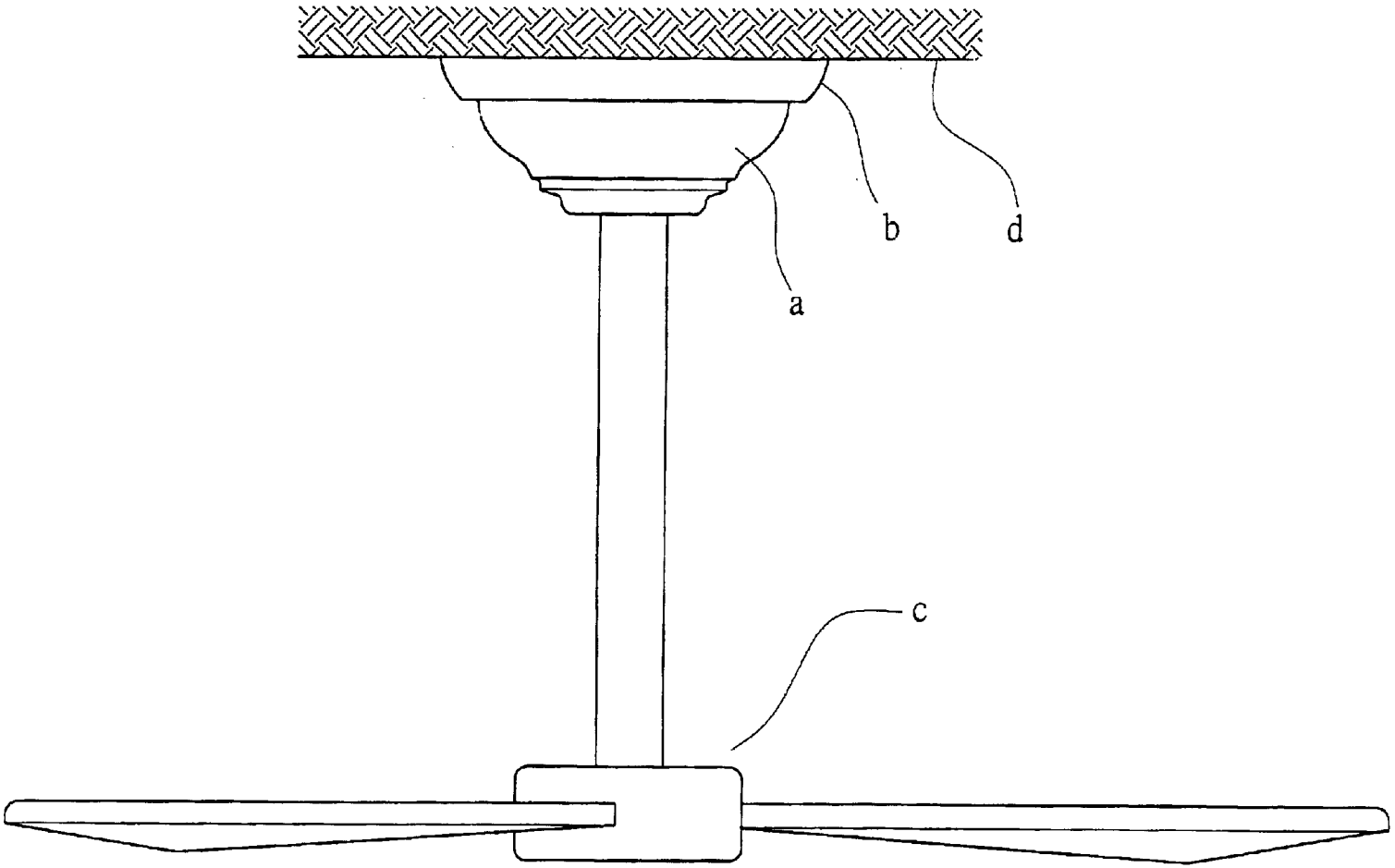
FIG.4 Prior Art
FIG. 4 shows a schematic view of an example of the prior art.

Referring to FIGS. 1 and 2, the integrated structure for ceiling fan base and frame comprises a base 10 and a frame 20. When the base 10 of a ceiling fan is fastened and suspended below a holder 50 at a ceiling using screws 40, the frame 20 is utilized to cover the screws 40 fastening the base 10 for enhancing esthetical values of the ceiling fan 1. The characteristics of the invention are that:

between the aforesaid base 10 and the frame 20 is provided with an inner rim 30 that is disposed with a plurality of pin openings 31 and a plurality of reinforcement ribs 32 at equidistant locations of an inner periphery of the inner rim 30, and each of the pin openings 31 is placed with a pin 33 having a round arched head 331; the shape of an inner periphery of the frame 20 is corresponded with an outer periphery of the inner rim 30, and two clasp portions 21 are disposed at corresponding positions at the inner periphery of the frame 20 so as to fasten and connect the frame 20 around the inner rim 30; and at positions having largest diameters on a periphery of the base 10 are provided with a plurality of orifices 11 corresponding to the pins 33 at the inner rim 30 so as to wedge the heads 331 of the pins 33 into the orifices 11 of the base 10 for assembly.

According to the aforesaid structure, a plurality of pin heads 331 form an imaginary diameter slightly smaller than a diameter of the periphery formed by the orifices 11 of the base 10 after the pins 33 are placed into the pin openings 31 of the inner rim 30. During assembly, the frame 20 is accommodated-around the inner rim 30, and is pushed upward along with the inner rim 30 such that the arched heads 331 of the pins 33 provided at the inner rim 33 are slid into the orifices 11 of the base 10, thereby readily installing the decorative frame 20 to the base 10. During disassembly, only downward forces imposed by hands of a user are needed for withdrawing the frame 20, and the frame 20 and the inner rim 30 may easily be pulled down to further separate from the base 10, thereby removing screws thereof and dismantling the ceiling fan.

In addition, as described in the aforesaid structure, a proper shape and degree of circularity of the frame 20 according to the invention are maintained using the inner rim 30, and therefore it is unnecessary to provide the frame 20 with reinforcement ribs at the inner periphery thereof. Consequently, surfaces of the outer periphery of the frame 20 are free from shrinkage during extrusion thereof, and uneven colors or indentations are not likely to occur after electroplating and burnishing, thereby increasing quality as well as economical values of the product.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An integrated structure of a ceiling fan base and a frame comprises said base and said frame, and the characteristics thereof are:

between the base thereof and the frame thereof is an inner rim that is disposed with a plurality of pin openings and a plurality of reinforcement ribs at equidistant locations of an inner periphery thereof, and each of the pin openings has placed therein a pin having a round arched head; the shape of an inner periphery of the frame corresponds with an outer periphery of the inner rim, and two clasp portions are disposed at corresponding positions at the inner periphery of the frame so as to fasten and connect the frame around the inner rim; and at positions having largest diameters on the periphery of the base are provided a plurality of orifices corresponding to the pins at the inner rim so as to wedge the heads of the pins into the orifices of the base for assembly.

2. The integrated structure of a ceiling fan base and a frame in accordance with claim 1, wherein the heads of the pins are round in shape.

3. The integrated structure of a ceiling fan base and a frame in accordance with claim 1, wherein a plurality of pin heads form an imaginary diameter slightly smaller than a diameter of a periphery formed by the orifices of the base after the pins are placed into the pin openings of the inner rim.

* * * * *